United States Patent [19]

Siegl et al.

[11] Patent Number: 4,790,878

[45] Date of Patent: Dec. 13, 1988

[54] CORROSION INHIBITING AQUEOUS COMPOSITIONS COMPRISING METAL-CHELATING DIPHENOLAMINE COMPOUNDS

[75] Inventors: Walter O. Siegl, Dearborn; Mohinder S. Chattha, Livonia, both of Mich.

[73] Assignee: Ford Motor Company, Dearborn, Mich.

[21] Appl. No.: 5,183

[22] Filed: Jan. 20, 1987

[51] Int. Cl.[4] ..... C11D 7/00; C11D 7/08; C23G 1/06; C04B 9/02

[52] U.S. Cl. ..... 106/14.15; 564/388; 564/389; 564/390; 252/148; 252/392; 252/142; 528/149; 528/99; 528/100; 525/490

[58] Field of Search ..... 106/14–15; 564/388, 389, 390; 252/148, 392; 528/149, 99, 100; 525/490

[56] References Cited

U.S. PATENT DOCUMENTS

| | | | |
|---|---|---|---|
| 2,802,810 | 8/1957 | Bell | 524/925 |
| 2,870,134 | 1/1959 | Kluge et al. | 568/75 |
| 2,957,908 | 10/1960 | Wiley et al. | 260/504 A |
| 3,183,093 | 5/1965 | Schlesinger et al. | 430/181 |
| 3,219,700 | 11/1965 | O'Shea et al. | 564/300 |
| 3,219,701 | 11/1965 | O'Shea | 564/300 |
| 3,632,637 | 1/1972 | Martell | 556/148 |
| 3,994,989 | 11/1976 | Kempter et al. | 525/490 |
| 4,001,155 | 1/1977 | Kempter et al. | 523/416 |
| 4,086,292 | 4/1978 | Kempter et al. | 528/99 |
| 4,433,015 | 2/1984 | Lindert | 427/388.4 |
| 4,444,942 | 4/1984 | Kempter et al. | 528/149 |
| 4,466,840 | 8/1984 | Frank et al. | 148/6.14 R |

FOREIGN PATENT DOCUMENTS 0591210 1/1960 Canada .

OTHER PUBLICATIONS

Pitt et al., "The Selection & Evaluation of New Chelating Agents for the Treatment of Iron Overload" J. Pharmacol. Exp. Ther., 208(1), 12–18 (1979).

*Primary Examiner*—Paul Lieberman
*Assistant Examiner*—Ronald A. Krasnow
*Attorney, Agent, or Firm*—Lorraine S. Melotik; Roger L. May

[57] ABSTRACT

This invention relates to an aqueous composition useful to deposit a corrosion inhibiting and adhesion promoting coating on a corrodible metal substrate and a method for doing same. The composition has a pH of between about 2 and about 10 and comprises water-soluble or water-dispersible metal-chelating diphenolamine compounds.

10 Claims, No Drawings

CORROSION INHIBITING AQUEOUS COMPOSITIONS COMPRISING METAL-CHELATING DIPHENOLAMINE COMPOUNDS

Reference is made to commonly assigned and concurrently filed related U.S. applications Ser. No. 005,181 entitled "Corrosion Inhibiting Aqueous, Acidic Compositions Comprising Metal-Chelating o-Hydroxybenzylamine Compound" and Ser. No. 005,182 entitled "Metal Chelating Diphenolamine Oligomers For Corrosion Inhibition of Metal Substrates", both to Siegl et al.

TECHNICAL FIELD

This invention relates to an aqueous composition useful to deposit a corrosion inhibiting and adhesion promoting coating on a corrodible metal substrate and a method for doing same. More particularly, the composition has a pH of between about 2 and about 10 and comprises water-soluble or water-dispersible metal-chelating diphenolamine compound.

BACKGROUND OF THE INVENTION

One means of minimizing the impact of corrosion on metal surfaces has been to coat the surface with paint. The paint acts as a barrier between the metal surface and the environment and thus helps to prevent or at least minimize corrosion of the metal surface. However, one problem associated with this solution is that paint does not always adhere properly to the metal surface. The result may be peeling, cracking, blistering, or flaking of the paint, thus rendering the substrate metal surface again subject to corrosion.

The need for applying protective coatings to metal surfaces for improved corrosion resistance and paint adhesion is well known in the metal finishing and other metal arts. One attempt to alleviate the problem of poor adhesion of paint to metal surfaces has been to subject the metal substrate to a treatment which is known as phosphating, i.e. a process by which the metal surfaces are treated with chemicals which form a metal phosphate conversion coating on the metal surface. Such treatment typically assists in rendering the metal surface less subject to corrosive attack and, at the same time, in rendering the surface more suitable for application of paint. The resulting bond between the metal surface and the paint is thus greatly improved. However, phosphate baths require that precise formulations be maintained and that the processing procedures and conditions of operation be controlled within narrow limits. The phosphating process also requires that the metal surface be given two rinses subsequent to the phosphating bath, the first being a water rinse and the second being a passivating solution rinse which further enhances the corrosion resistance and adhesion characteristics of the coating. Traditionally, conversion coated metal surfaces have been given a second rinse with a solution containing a hexavalent chromium compound.

Lindert, in U.S. Pat. No. 4,433,015, teaches that, because of the toxic nature of hexavalent chromium compounds, expensive treatment equipment must be used to remove chromates from water effluent to prevent the pollution of rivers, streams and drinking water sources. Hence, in recent years there have been research and development efforts directed to discovering effective alternatives to the use of such post-treatment solutions.

Lindert teaches that an alternative to the hexavalent chromium compound is a polymer having phenol groups attached along an ethylenic polymer backbone. The phenol groups may have a amine substituent which may further comprise hydroxy-alkyl groups. The polymer, made water soluble through neutralization of the amine moiety with organic acid may be employed in an acidic or basic solution. It is also taught by Lindert that this solution, in addition to being used as a post-phosphate rinse, may be used to treat previously untreated metal surfaces including aluminum and zinc.

Frank et al, in U.S. Pat. No. 4,466,840, teach that there exists a need for a simple means to achieve results similar to that obtained with the phosphating process without the complexity of such a treatment. As an alternative to such phosphating treatment, Frank et al propose employing hydroxybenzylamines, preferably in aqueous solution, to produce coatings on metal surfaces, which coatings act as corrosion inhibitors and adhesion promotors. The amine moiety of these hydroxybenzylamines comprises secondary amine having alkyl substituents.

Embodiments of the diphenolamine of the present invention aqueous, acidic composition have been described in U.S. Pat. Nos. 2,802,810, 2,870,134, 2,957,908, 3,219,700, 3,219,701 and 3,183,093. U.S. Pat. No. 2,802,810 to Bill teaches diphenolamines which are useful as antioxidants in natural and synthetic rubbers. U.S. Pat. No. 2,870,134 to Kluge et al teaches the preparation of calcium phenolates and sulfurized calcium phenolates for use as sludge dispersants in lubricating oils, which preparation involves the use of diphenolamines. U.S. Pat. No. 2,957,908 teaches the stabilization of dibasic magnesium sulfates by a magnesium or calcium salt of diphenolamines, which contributes to the materials detergent action in lubricating oil. U.S. Pat. No. 3,219,700 to O'Shea et al and U.S. Pat. No. 3,219,701 to O'Shea are directed to methods of preparing hydroxy-benzyl amines useful as lubricating oil additives. U.S. Pat. No. 3,183,093 to Schlesinger teaches the use of diphenolamines with azo compounds in light sensitive coatings.

Neither of the above references to Lindert or Frank et al teaches the metal-chelating compound of the present invention aqueous, acidic composition. Still further, while references have been discussed above which teach embodiments of the diphenolamine compound employed in the present invention composition, none of these references suggests employing those compounds in an aqueous composition useful to deposit an adhesion promoting and corrosion inhibiting coating on metal surfaces as in this invention.

DISCLOSURE OF THE INVENTION

The present invention is directed to an aqueous composition useful to deposit a corrosion inhibiting and adhesion promoting coating on a corrodible metal substrate. The composition has a pH of between about 2 and about 10 and comprises at least about 0.01 weight percent, preferably between about 0.1 and about 5 weight percent, of water-soluble or water-dispersible diphenolamine metal-chelating compound selected from compounds having the general chemical formula:

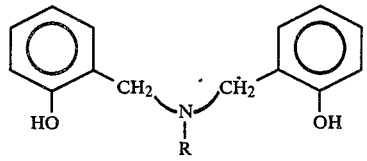

wherein R is alkyl, aryl or hydroxy alkyl. Preferably, R is a hydroxy alkyl group containing a hydroxyl group 2 or 3 carbons removed from the nitrogen. For use on bare metal (i.e., a non-phosphated metal substrate), the pH of the composition is preferably between about 2.5 and 3.5, while for use on phosphated metal, the pH of the composition is preferably between about 6.0 and 10.0.

This invention is also directed to a method for depositing an adhesion promoting and corrosion inhibiting coating on a corrodible metal substrate, which method comprises contacting the substrate with the above described composition for a time sufficient to deposit a coating comprising water-insoluble diphenolamine metal-chelate compounds thereon.

In an acidic solution, metal ions are liberated from the surface of a metal substrate. When a metal substrate is contacted with an aqueous, acidic composition of the present invention, metal ions, e.g., $Fe^{+3}$, are liberated from the substrate surface and form a complex with metal-chelating compound present in the composition. It is believed that the compound's ability to chelate metal ions is based on the fact that the hydroxyl group of the phenol is ortho in position to the amine moiety and that the amine moiety is only separated from the phenol by one carbon. In particular, the two hydroxyl groups and the nitrogen in this defined arrangement chelate with the metal ion. While the metal-chelating compound is water-soluble or water-dispersible, the metal-chelate compound formed, is, on the other hand, insoluble in the aqueous, acidic composition and precipitates onto the substrate to form a coating. Similarly, when a phosphated metal is contacted with a basic or slightly acidic composition of the present invention, metal ion, e.g., $Fe^{+3}$ or $Zn^{+2}$, is liberated from the phosphate coating which can then form an insoluble complex with the metal-chelating compound of the composition. While the above theory is advanced to explain the ability of the metal-chelating compound of the composition to form a coating, neither its accuracy nor its understanding is necessary for operation of the present invention.

Advantageously, the present invention composition overcomes the deficiencies of prior art compositions and methods as described above and provides a composion and method for depositing a coating on a metal substrate for inhibiting corrosion of the metal substrate and for improving adhesion of paint thereto. Advantageously, the adhesion promoting ability of the present invention coating is also effective when employed with organic adhesives.

DETAILED DESCRIPTION OF THE INVENTION

The composition of the present invention comprises at least about 0.01 weight percent of a water-soluble or water-dispersible diphenolamine metal-chelating compound, preferably the composition comprises this compound in an amount between about 0.1 and about 5 weight percent. While amounts greater than this preferred amount may be employed in the composition, it does not appear that the corrosion protection provided by the resultant coating is further substantially enhanced. Thus, it does not appear commercially advantageous to employ such greater amounts. However, under some circumstances, for example for transporting or storing the solution, the concentrate of the composition may be preferred. Thus, compositions generally comprising up to about 30 percent of the treatment compound may be provided. From a commercial point of view, a suitable concentrate of this invention comprises from about 5 percent to about 30 percent of the treatment compound.

The water-soluble or water-dispersible metal-chelating compound of the present invention aqueous composition is selected from compounds having the general chemical formula:

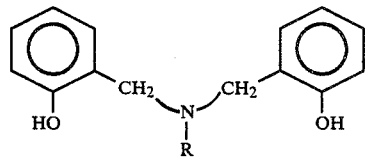

wherein R is selected from alkyl, aryl or hydroxy alkyl. Preferably, R is a hydroxy alkyl group containing a hydroxyl group 2 or 3 carbons removed from the nitrogen. Most preferably, R is an ethanol or propanol moiety. The phenol ring and the hydroxy alkyl group may be substituted with non-interfering functionality, i.e., functionality that would not substantially interfere with the intended use of these compounds according to the described present invention. Exemplary non-interfering functionality which may be present on the phenol ring and hydroxy alkyl group is alkyl, alkoxy, aryl and halogen. Preferably, the phenol ring and hydroxy alkyl group are unsubstituted or substituted with alkyl or aryl and more preferably, when substituted, are substituted with alkyl of 1 to 4 carbons. As would be understood by one skilled in the art in view of the present disclosure, it is intended that such groups may be of carbon chain lengths at which the compound is water-soluble or water-dispersible, as may be necessary, with the aid of acids or bases. Preferably, such compound have molecular weights of up to about 2000.

These compounds may be prepared by conventional techniques known to those skilled in the art and described in various publications. Exemplary of such techniques are those described in U.S. Pat. Nos. 2,802,810, 2,870,134, 2,957,908, 3,219,700, 3,219,701 and 3,183,093, discussed above, which patents are hereby expressly incorporated by reference for their teachings of such techniques. One such method comprises reacting 2 mole equivalents of a phenol, substituted phenol or a mixture of phenols, having at least one (1) unsubstituted ortho-position, e.g., 2,4-dimethylphenol, 1 mole equivalent of a primary amine, preferably a hydroxyalkylamine containing a hydroxyl group 2 or 3 carbon removed from the nitrogen, e.g., ethanolamine, with 2 mole equivalents of formaldehyde for a time and under conditions sufficient to form the diphenolamine.

The treatment compositio of the present invention is an aqueous solution composition having a pH of between about 2 and about 10. For use on bare metal, the pH of the composition is preferably between about 2.5 and 3.5, while for use on phosphated metal, the pH of the composition is preferably between about 5.0 and 10.0. Organic or inorganic acids may be employed to provide acidic character (pH) to the composition and assist in solubilzing or dispersing the metal chelating compound should such be necessary. Many such acids are known in the art. Preferably, acids so employed are acids of strongly coordinating anions such as phosphoric acid, sulfuric acid, hydrochloric acid, oxalic acid and acetic acid, acids of weakly coordinating ions, e.g., $ClO^{-4}$, being less effective. Mixtures of compatible acids may also be employed to provide the desired pH to the aqueous composition. Preferably, bases, such as NaOH, KOH, and $NH_4OH$, are employed to provide basic character to the composition and assist in solubilizing the compound, should such be necessary. Other bases which may be suitably used will be apparent to those in the art in view of the present disclosure. Mixtures of compatible bases may also be employed.

Optional materials which may be included in the composition of this invention include those materials commonly employed in corrosion inhibiting and adhesion promoting compositions. Exemplary of such materials are dispersing agents, pigments, adhesion promoters and solubilizers such as polyacrylic acid, polyamines, and polyphenols (e.g., novolak resins) and compatible corrosion inhibitors. The aqueous composition of this invention may also comprise an alcohol as a co-solvent (i.e. in addition to the water), which alcohol has been found useful to produce a clear solution. Exemplary alcohols which may be so employed include, but are not limited to, methanol, ethanol, isopropanol and propasol-P (trademark, Union Carbide Corp.).

As in a typical metal treatment operation, the metal to be treated with the aqueous composition of the present invention is initially cleaned by a chemical and/or physical process and water rinsed to remove grease and dirt from the surface. The metal surface is then brought into contact with the treatment solution of this invention. The present invention is useful to coat a broad range of metal surfaces, including zinc, iron, aluminum, tin, copper and their alloys, including cold-rolled, ground, pickled, hot rolled steel and galvanized steel surfaces. The metal surface may be in any physical form, such as sheets, tubes, or rolls.

The corrosion inhibiting adhesion promoting composition of the present invention may be applied to metal surfaces in any convenient manner. Thus, it may be sprayed, painted, dipped or otherwise applied to the metal surface. The temperature of the applied solution can vary over a wide range, from the solidification temperature of the solution or dispersion to the boiling point of the solution or dispersion. During application to the metal surface, the temperature of the composition of this invention is preferably between about 20° C. and 80° C., more referably between about 20° C. and 55° C. It is generally believed that a substantially uniform layer of the corrosion inhibitor/adhesion promoter coating should be deposited on the metal surface. It is also believed that something approaching a molecular layer is sufficient to achieve the desired results. Useful contact time has been found to be about 0.25 to about 5 minutes with contact times between about 0.25 and 1 minute being sufficient at about room temperature. As will be apparent to those in the art in view of the present disclosure, treatment time and temperature of the applied composition may vary from those described. Selection of optimal composition and method parameters, such as concentration of the diphenolamine metal-chelating compound, pH, optional materials, contact time, and bath temperature during coating, would be dependent, in part, on the particular substrate, processing conditions and final coating desired. As such, selection of such parameters will be within the skill of those in the art in view of the present disclosure.

After application of the treatment solution to the metal surface, the surface is preferably rinsed when such surface is a non-phosphated metal surface. Such rinsing is optional for a phosphated metal surface. Although, in either case, good results can be obtained without rinsing after treatment. For some end uses, for example, in electrocoat paint application, rinsing may be preferred with either type of substrate. Next, the treated metal surface is dried. Drying can be carried out by, for example, circulating air or oven drying. While room temperature drying can be employed, it is preferable to use elevated temperatures to decrease the amount of drying time required. After drying, the treated metal surface is ready for painting or the like. The surface is suitable for standard paint or other coating application techniques such as brush painting, spray painting, electro-static coating, dipping, roller coating, as well as electrocoating. As a result of the treatment step of the present invention, the metal chelate compound coated surface has improved paint adhesion and corrosion resistance characteristics. Additionally, this coated surface acts to improve the adhesion when conventional adhesive materials are used to affix one such coated surface to another.

The invention will be further understood by referring to the following detailed examples. It should be understood that the specific examples are presented by way of illustration and not by way of limitation. Unless otherwise specified, all references to "parts" is intended to mean parts by weight.

EXAMPLE 1

To 24.4 g (0.2 mole) of 2,4-dimethylphenol and 6.1 g (0.1 mole) of 2-aminoethanol in 50 ml of ethanol was added 16.1 g (0.2 mole) of 37% formaldehyde solution. The solution was heated with stirring at reflux. After 24 hours, the reaction mixture was allowed to cool and the solvent was removed under reduced pressure. The pale yellow oil which remained was triturated with toluene and the resulting white solid collected. Recrystallization of the solid from toluene afforded 15.6 g of white crystals, m.p. 108°–109° C. The infrared and nmr spectra were consistent with the expected structure of a diphenolamine of the present invention composition.

0.5 g of the diphenolamine product from 2,4-dimethylphenol, ethanolamine and formaldehyde was dissolved in 500 ml of ethanol/water (1:4 by volume) and the pH was adjusted to 3 with phosphoric acid to make a 0.1% (weight) solution according to this invention.

Cold rolled steel panels (Parker Chemical Co., Detroit, Mich.) were rinsed with toluene and with acetone to remove shipping oils and were then dipped in the solution described above for 1 minute at 23° C. After draining for approximately 30 seconds, the panels were rinsed with deionized water, allowed to drain, and then oven dried for 10 minutes at 110° C. These panels were then sprayed with a tall oil modified bisphenol A-epichlorohydrin epoxy resin/crosslinked with alkylated melamine resin primer and cured at 150° C. for 20 minutes. The painted panels were scribed and tested by the standard salt spray method (ASTM B-117). The panels had a cured paint thickness of 28–33 μm. The painted panels, treated with the diphenolamine solution described above, did not fail until after 9–12 days of salt spray exposure, whereas similarly painted panels, prepared as above except that deionized water was used in place of the diphenolamine solution of this example, failed in 3 days. Failure is defined as 4 mm of paint loss (undercutting) on either side of the scribe line).

EXAMPLE 2

The diphenolamine product (0.50 g) from 4-methylphenol, ethanolamine, and formaldehyde (mole ratios 2:1:2 respectively) made according to the technique of Example 1 was dissolved in 500 ml of ethanol/water (1:4 by volume) and the pH was adjusted to 3 with phosphoric acid to make a 0.1% (weight) solution according to this invention.

Cold-rolled steel panels were cleaned, and treated with the metal-chelating solution of this example, and rinsed according to the procedure of Example 1. The treated panels were then spray painted with primer and cured as described in Example 1. Subsequently, the painted panels were scribed and salt spray tested (ASTM B-117). The painted panels so treated did not fail until after exposure to salt spray for 7 days.

EXAMPLE 3

The diphenolamine product (0.50 g) from 2,4-dimethylphenol, amylamine, and formaldehyde (mole ratios 2:1:2, respectively) made according to the technique of Example 1 was dissolved in 500 ml of ethanol-amine (1:4 by volume) and the pH was adjusted to 3 by the addition of phosphoric acid to make a 0.1% (weight) solution according to this invention.

Cold-rolled steel panels were cleaned and treated with the metal-chelating solution of this example according to the procedure of Example 1. The treated panels were then spray painted with primer and cured as described in Example 1. Subsequently, the painted panels were scribed and salt spray tested (ASTM B-117). The painted panels so treated did not fail until after exposure to salt spray for 5–6 days.

EXAMPLE 4

The diphenolamine product (0.05 g) from 2,4-dimethylphenol, D-glucosamine hydrochloride, and formaldehyde, made according to the technique of Example 1 in mole ratios of 2:1:2, respectively, is dissolved in 500 ml of water The pH of the solution is adjusted to 3 with phosphoric acid to make a 0.1% solution (weight) according to this invention.

Cold-rolled steel panels are cleaned, treated with the metal-chelating solution of this example, and rinsed according to the procedure of Example 1. The treated panels are then spray painted with primer and cured as described in Example 1. Subsequently, the painted panels are scribed and salt spray tested (ASTM B-117). The painted panels so treated show improved corrosion resistance over untreated panels. Hereafter in the examples, untreated panels are defined as similarly painted panels prepared according to the procedure of the example except that deionized water was used in place of the metal-chelating solution.

EXAMPLE 5

The diphenolamine product (0.50 g) from 2,4-dimethylphenol, 3-amino-1-propanol, and formaldehyde, made according to the technique of Example 1 in a mole ratio of 2:1:2, respectively, is dissolved in 500 ml of ethanol/water (1:4 by volume). The pH of this solution is adjusted to 3 with phosphoric acid to make a 0.1% (weight) solution according to this invention.

Cold-rolled steel panels are cleaned, treated with the metal-chelating solution of this example and rinsed according to the procedure of Example 1. The treated panels are then spray painted with primer and cured as described in Example 1. Subsequently, the painted panels are scribed and salt spray tested (ASTM B-117). The painted panels so treated show improved corrosion protection over untreated panels.

EXAMPLE 6

A diphenolamine product (0.5 g) made according to Example 1 was dissolved in 500 ml of ethanol/water (2:3 by volume). The pH of the solution was adjusted to 6.1 with phosphoric acid to make a 0.1% (weight) solution according to this invention.

Iron phosphated panels (P-1000, trademark, Parker Chemical Co.) were dipped in the solution for 30 seconds at 49° C., rinsed with deionized water, and dried for 5 minutes at 180° C. The panels were sprayed with Duracron 200 (trademark, PPG Industries) paint, scribed, and tested by salt spray method (ASTM B-117). After 14 days, the painted panels so treated showed less paint loss than did untreated panels.

EXAMPLE 7

The procedure of Example 6 is repeated except that the deionized water rinse for the panels treated with the diphenolamine solution was omitted. Panels so treated show less paint loss, after salt spray testing (ASTM B-117), than untreated panels.

EXAMPLE 8

The procedure of Example 1 is repeated except that sulfuric acid is used to adjust the pH. Panels so treated show less paint loss, after salt spray testing (ASTM B-117), than untreated panels.

EXAMPLE 9

The procedure of Example 1 is repeated except that the dip time of the panels in the diphenolamine solution is 15 seconds. Panels so treated show less paint loss, after salt spray testing (ASTM B-117), than untreated panels.

EXAMPLE 10

The procedure of Example 4 is repeated except that aluminum panels are treated instead of the steel panels. Panels so treated show less paint loss, after salt spray testing (ASTM B-117), than untreated panels.

EXAMPLE 11

Cold-rolled steel coupons (1"×4") were cleaned with toluene and acetone and treated with the metal chelating solution of Example 1. The treated coupons were bonded in a single overlap (1" square) joint with a 2-component epoxy adhesive (Quantum Composite Co.). The bond strength was tested on an Instron mechanical test apparatus. The bond strength showed a 77% improvement over untreated coupons bonded in this fashion. After 2 weeks in a humidity chamber (40° C., 95% relative humidity), the bond strength was 95% greater for treated coupons.

EXAMPLE 12

The procedure of Example 11 was repeated except that the adhesive employed was a urethane adhesive (Fuller Co.). After 2 weeks in a humidity chamber (40° C., 95% relative humidity), the bond strength was 28% greater than for untreated coupons.

In view of this disclosure, many modifications of this invention will be apparent to those skilled in the art. It is intended that all such modifications which fall within the true scope of this invention be included within the terms of the appended claims.

We claim:

1. An aqueous composition useful to deposit a corrosion inhibiting coating on a corrodible metal substrate, said composition (1) having a pH of between about 2 and about 5 and (2) consisting essentially of at least about 0.01 weight percent of a water-soluble or water-dispersible diphenolamine metal-chelating compounds selected from compounds having the general chemical formula:

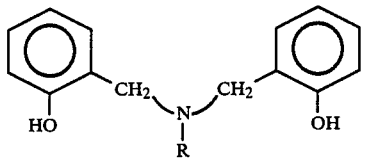

wherein R is alkyl, aryl or hydroxy alkyl.

2. The aqueous composition according to claim 1, suitable for use on non-phosphated metal substrate, wherein said pH of said composition is between about 2.5 and about 3.5.

3. The aqueous composition according to claim 1, wherein said composition comprises between about 0.1 and about 5 weight percent of said diphenolamine metal-chelating compound.

4. The aqueous composition according to claim 1, wherein R is a hydroxy alkyl group containing a hydroxyl group 2 or 3 carbons removed from the nitrogen.

5. The aqueous composition according to claim 4, wherein R is ethanol or propanol moiety.

6. The aqueous composition according to claim 1, wherein said diphenolamine metal-chelating compound has a molecular weight of up to about 2000.

7. The aqueous composition according to claim 1, wherein said composition further comprises alcohol.

8. The aqueous composition according to claim 1, wherein the temperature of said composition is between about 20° and about 55° C.

9. The aqueous composition according to claim 1, wherein the composition is made acidic by means of acid selected from phosphoric acid, sulfuric acid, hydrochloric acid, acetic acid, oxalic acid and a compatible mixture thereof.

10. The aqueous composition according to claim 1, wherein the composite is made basic by means of base selected from sodium hydroxide, potassium hydroxides ammonium hydroxide and a compatible mixture thereof.

* * * * *